US009173469B2

(12) United States Patent
Zhang

(10) Patent No.: US 9,173,469 B2
(45) Date of Patent: Nov. 3, 2015

(54) APPARATUS FOR CUTTING HAIR

(76) Inventor: Xiao Jing Zhang, Vancouver (CA)

( * ) Notice: Subject to any disclaimer, the term of this patent is extended or adjusted under 35 U.S.C. 154(b) by 0 days.

(21) Appl. No.: 13/701,285

(22) PCT Filed: May 30, 2011

(86) PCT No.: PCT/CA2011/050325

§ 371 (c)(1),
(2), (4) Date: Nov. 30, 2012

(87) PCT Pub. No.: WO2011/150514

PCT Pub. Date: Dec. 8, 2011

(65) Prior Publication Data

US 2013/0068244 A1 Mar. 21, 2013

Related U.S. Application Data

(60) Provisional application No. 61/350,273, filed on Jun. 1, 2010.

(51) Int. Cl.

| | |
|---|---|
| ***A45D 24/42*** | (2006.01) |
| ***A45D 24/36*** | (2006.01) |
| *A45D 24/06* | (2006.01) |

(52) U.S. Cl.

CPC ..... *A45D 24/36* (2013.01); *A45D 24/06* (2013.01)

(58) Field of Classification Search

CPC ..... A45D 24/14; A45D 24/40
USPC ..... 132/213–214, 103, 121, 143, 144, 148, 132/124, 126, 139, 140, 161, 106, 152, 159, 132/107, 128–132, 134–135, 154
See application file for complete search history.

(56) References Cited

U.S. PATENT DOCUMENTS

| | | | | | |
|---|---|---|---|---|---|
| 302,734 | A | * | 7/1884 | Jobson | 132/142 |
| 930,678 | A | * | 8/1909 | Moore | 132/126 |
| 1,663,468 | A | * | 3/1928 | Vaughn | 132/124 |
| 1,845,331 | A | * | 2/1932 | Pross | 132/110 |
| 1,942,753 | A | * | 1/1934 | Griffin | 132/159 |
| 2,303,643 | A | * | 12/1942 | Illingworth | 132/119 |
| 2,348,339 | A | | 5/1944 | Golden | |
| 2,661,007 | A | * | 12/1953 | Bauer | 132/142 |
| 3,192,934 | A | * | 7/1965 | Catania | 132/136 |
| 3,335,731 | A | * | 8/1967 | Bulow | 132/150 |
| 3,696,823 | A | | 10/1972 | Dannat | |
| 4,400,879 | A | | 8/1983 | Hildreth | |
| 5,131,418 | A | * | 7/1992 | Vaccaro | 132/213.1 |
| 5,626,153 | A | | 5/1997 | Petrarca | |
| 5,937,868 | A | * | 8/1999 | Ogunro | 132/213.1 |
| 6,047,704 | A | | 4/2000 | Giordano | |

(Continued)

OTHER PUBLICATIONS

International Search Report issued against PCT/CA2011/050325.

(Continued)

*Primary Examiner* — Todd Manahan
*Assistant Examiner* — Brianne Kalach
(74) *Attorney, Agent, or Firm* — Cameron IP

(57) ABSTRACT

An apparatus for cutting a person's hair, having a comb with a spine, a handle that extends axially from the spine and a plurality of teeth that extends transversely from the spine, and at least one finger that extends transversely from the spine substantially perpendicularly to the plurality of teeth, the at least one finger terminating in a lobe that is shaped to comfortably follow a surface of the person's head and shaped to gently scoop and lift hair away from the person's head.

7 Claims, 13 Drawing Sheets

(56) References Cited

U.S. PATENT DOCUMENTS

| | | | | |
|---|---|---|---|---|
| 7,389,779 | B2 | 6/2008 | Chan | |
| 2009/0032043 | A1 | 2/2009 | Gaugler | |
| 2011/0146084 | A1 * | 6/2011 | Melton et al. | 30/233.5 |

OTHER PUBLICATIONS

Written Opinion of the International Searching Authority issued against PCT/CA2011/050325.

* cited by examiner

APPARATUS FOR CUTTING HAIR

BACKGROUND

1. Field

The present invention is directed to devices for cutting hair, and in particular devices for cutting hair in cooperation with a comb.

2. Description of the Related Art

Cutting hair successfully is a challenging art. It is difficult to accomplish a proportionate cut all around the head, and hence it is difficult to achieve predictable and reproducible results. Results can vary unsettlingly between visits to the stylist and between stylists.

In general, high degrees of skill and experience are required to deliver a proportionate cut on a predictable and reproducible basis. Good stylists become adept at manipulating both comb and scissors in one hand: gathering hair with hand and comb, measuring length of cut, and then cutting. To measure out the length of cut, they typically place some combination of their hand, fingers, thumb and comb against the clients scalp.

This traditional process requires a careful eye and practiced dexterity to accomplish a quality cut in an economically efficient amount of time. It has been recognized that new and less-skilled stylists may not be able to deliver quality cuts with these techniques, particularly in an economically efficient amount of time. There has therefore been a need for measurement and cutting aids.

The related art generally teaches a comb combined with some kind of guide that indicates a consistent length of cut. This art tends to suffer from two shortcomings. Some aids are not adjustable, so that they only facilitate one length, angle and kind of cut. Other aids are adjustable as to length of cut, but are sufficiently cumbersome that they provide questionable assistance to a stylist or a person cutting his or her own hair.

What is needed is an aid that is adjustable for length and angle of cut, an aid that not only isn't cumbersome but can accommodate both left-handed and right-handed stylists and people who cut their own hair.

SUMMARY OF THE INVENTION AND ADVANTAGES

The present invention is directed to such an aid.

According to one aspect of the present invention, there is provided an apparatus for cutting a person's hair, having a comb with a spine, a handle that extends axially from the spine, and a plurality of teeth that extends transversely from the spine, and at least one finger that extends transversely from the spine substantially perpendicularly to the plurality of teeth, the at least one finger terminating in a lobe that is shaped to comfortably follow a surface of the person's head and shaped to gently scoop and lift hair away from the person's head.

The at least one finger may have a first plurality of fingers connected together.

The spine may have a channel for releasably retaining the at least one finger. The channel may have at least one eye and the at least one finger may have at least one hook that is complementary with the at least one eye for releasable retainment. The spine may have a plurality of eyes that are complementary with the at least one hook for releasably retaining the at least one finger in a plurality of positions along the spine.

The comb may have one or more eyes in the handle to provide temporary storage for one or more fingers not currently being used.

The at least one finger may further include a second plurality of fingers connected together.

The first plurality of fingers and the second plurality of fingers may differ in at least one of number of fingers, length of fingers and spacing between fingers. The spacing between at least one of the teeth, the fingers, and the teeth and the fingers may be selected so that the comb passes comfortably through the person's hair, so that the hair can be lifted, measured, cut and more generally styled. The spacing between adjacent teeth may be substantially 2 mm and the spacing between adjacent fingers may be substantially 12 mm.

The plurality of teeth may include a first plurality of teeth and a second plurality of teeth that extend oppositely.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Structure

Figure 1:
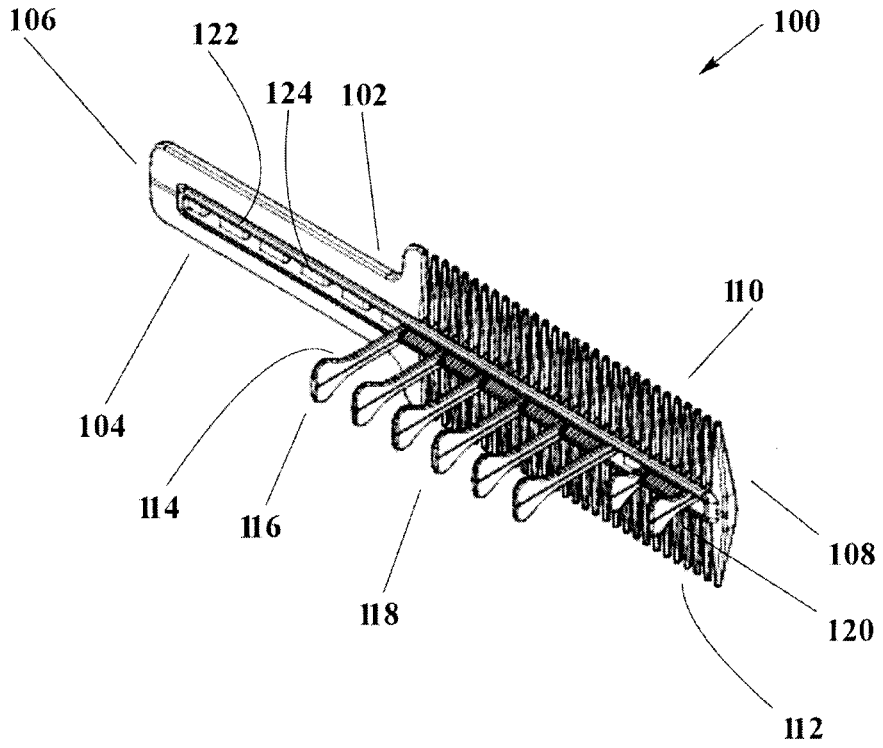
FIG. 1 is an oblique view of one embodiment of an apparatus for cutting hair.
Figure 2:
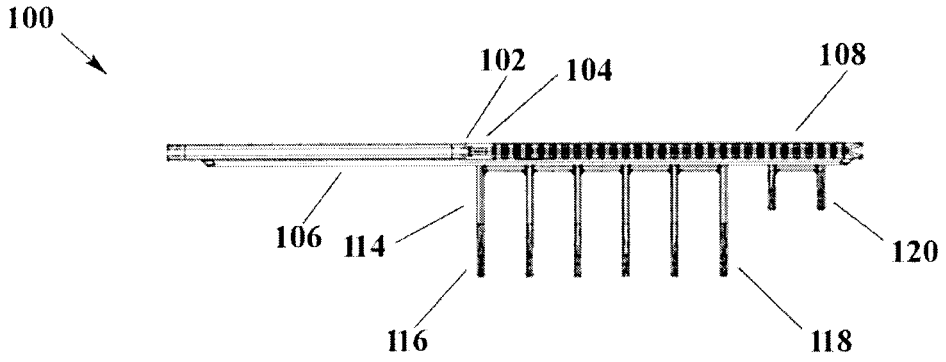
FIG. 2 is a side view of the apparatus of FIG. 1.
Figure 3:
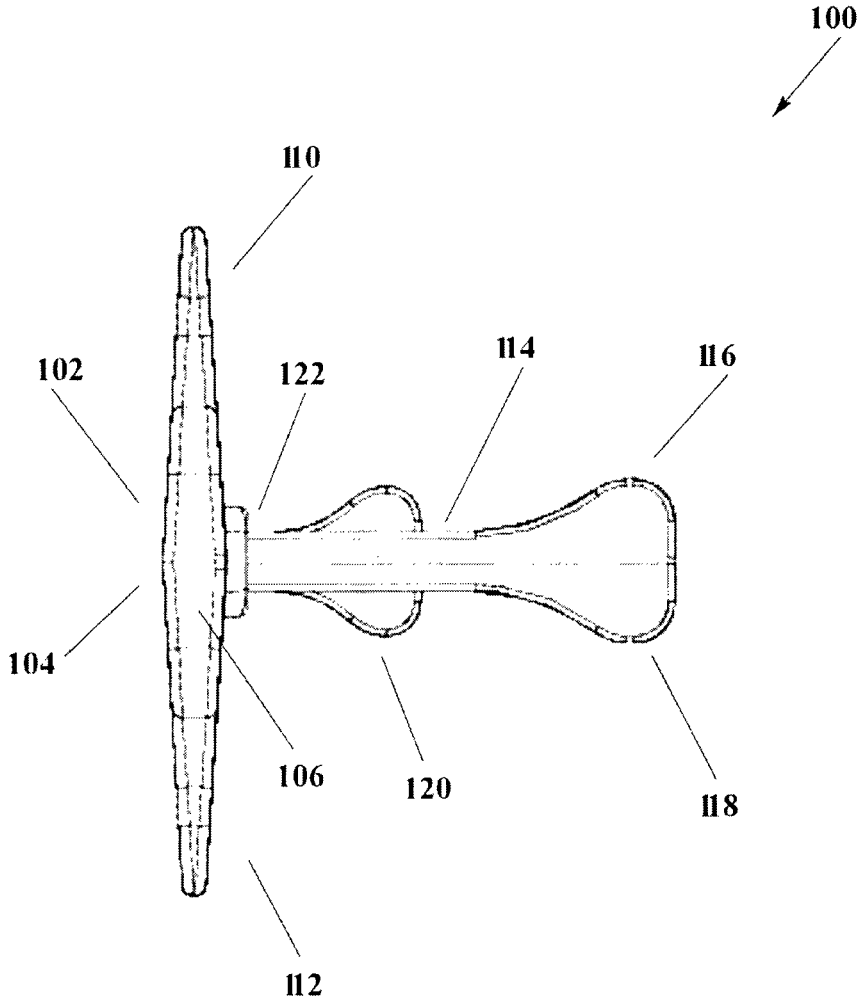
FIG. 3 is a handle-end view of the apparatus of FIG. 1.
Figure 4:
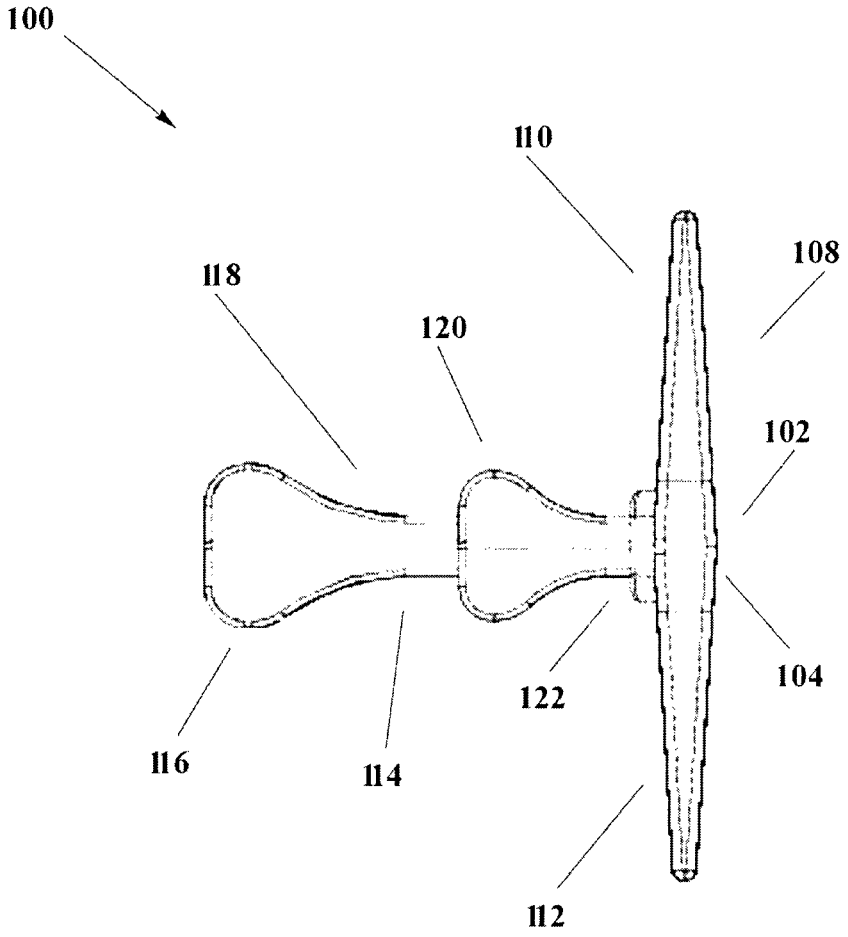
FIG. 4 is a tooth-end view of the apparatus of FIG. 1.
Figure 5:
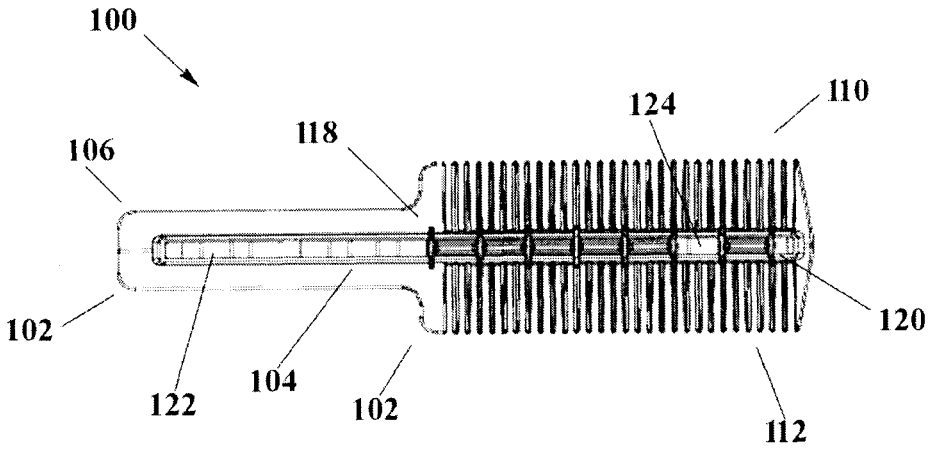
FIG. 5 is a front view of the apparatus of FIG. 1.
Figure 6:
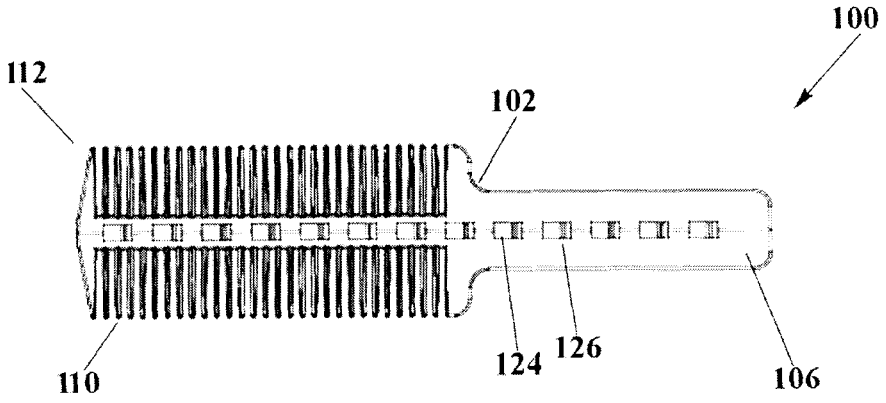
FIG. 6 is a back view of the apparatus of FIG. 1.
Figure 7:
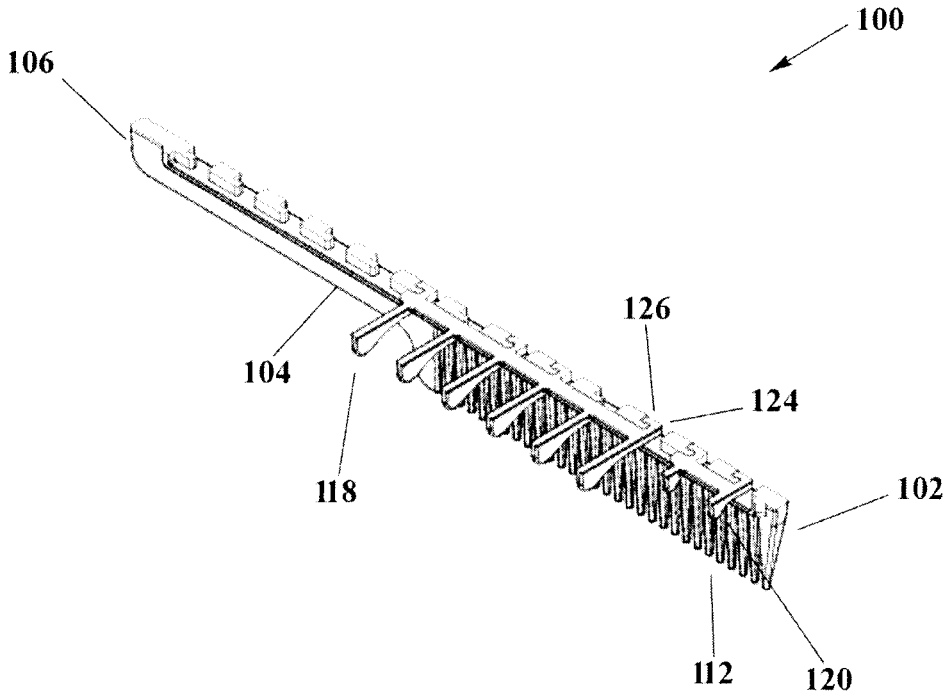
FIG. 7 is longitudinal sectional view of the apparatus of FIG. 1.
Figure 8:
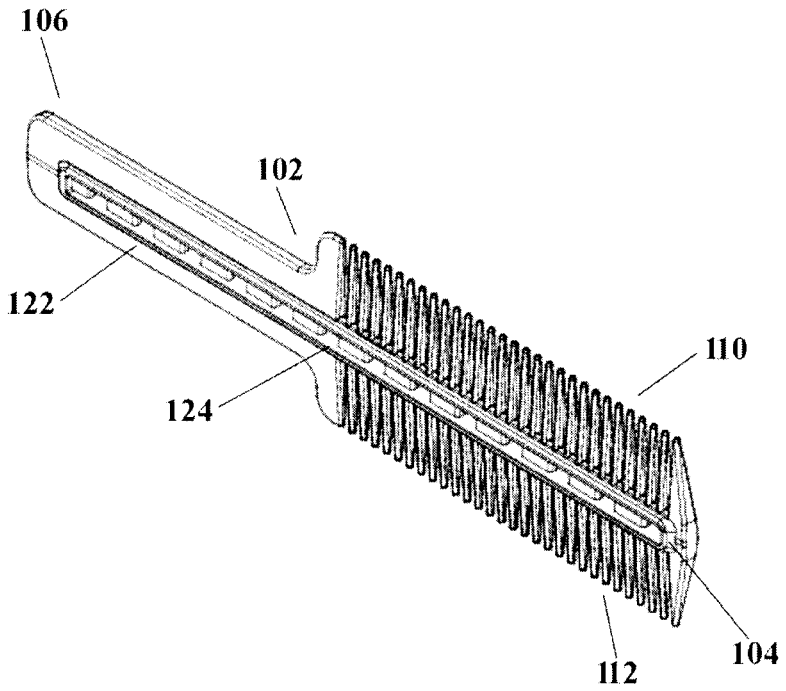
FIG. 8 is an oblique view of a comb portion of the apparatus of FIG. 1.
Figure 9:
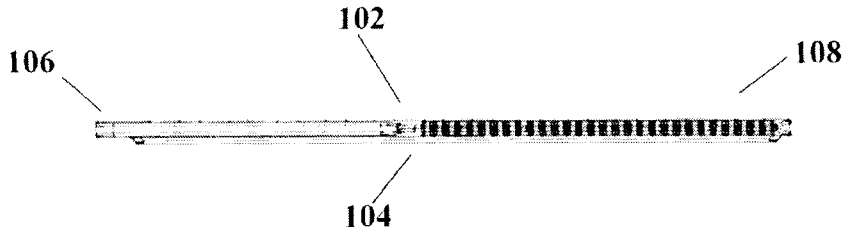
FIG. 9 is a side view of the comb portion of FIG. 8.
Figure 10:
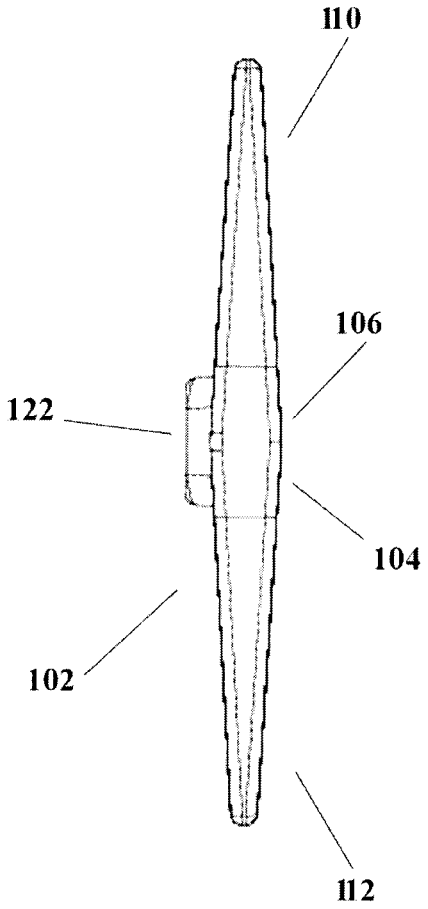
FIG. 10 is a handle-end view of the comb portion of FIG. 8.
Figure 11:
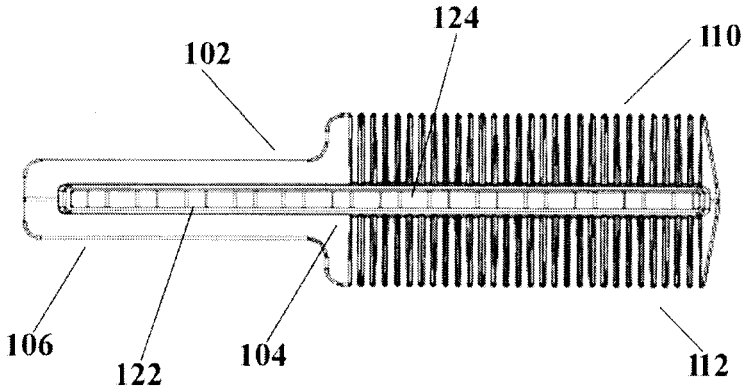
FIG. 11 is front view of the comb portion of FIG. 8.
Figure 12:
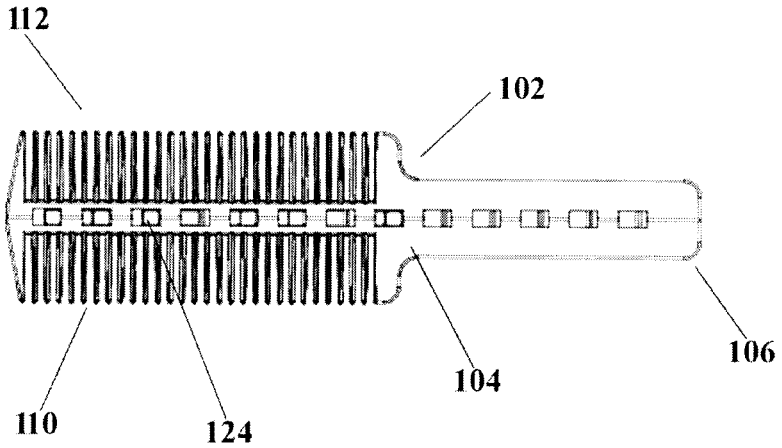
FIG. 12 is a back view of the comb portion of FIG. 8.
Figure 13:
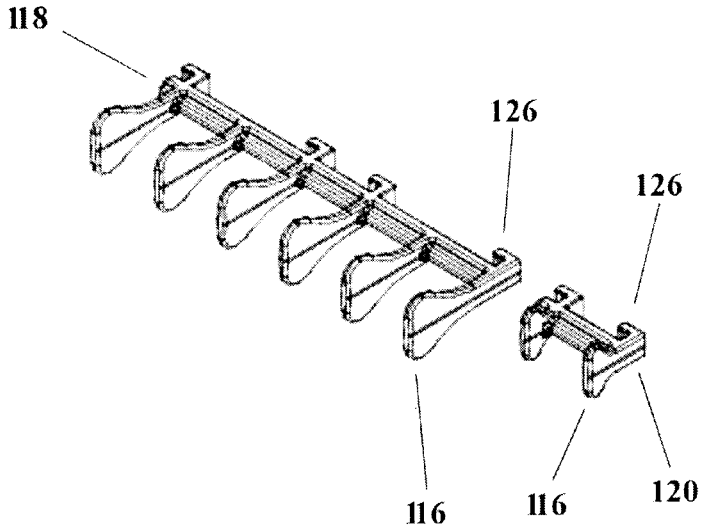
FIG. 13 is an oblique view of a finger portion of the apparatus of FIG. 1.
Figure 14:
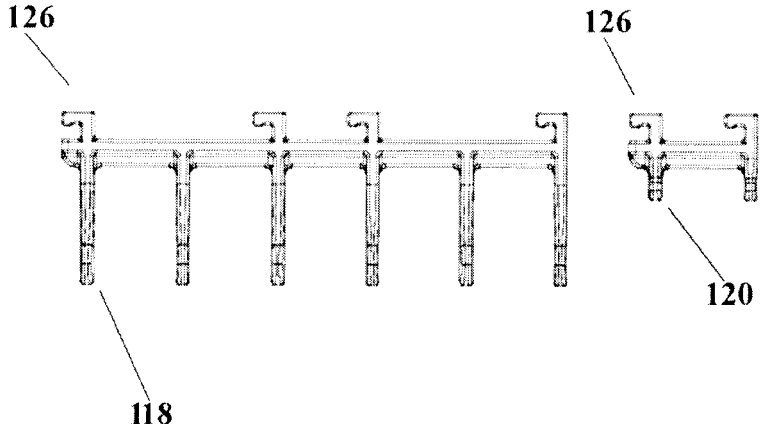
FIG. 14 is a side view of the finger portion of FIG. 13.
Figure 15:
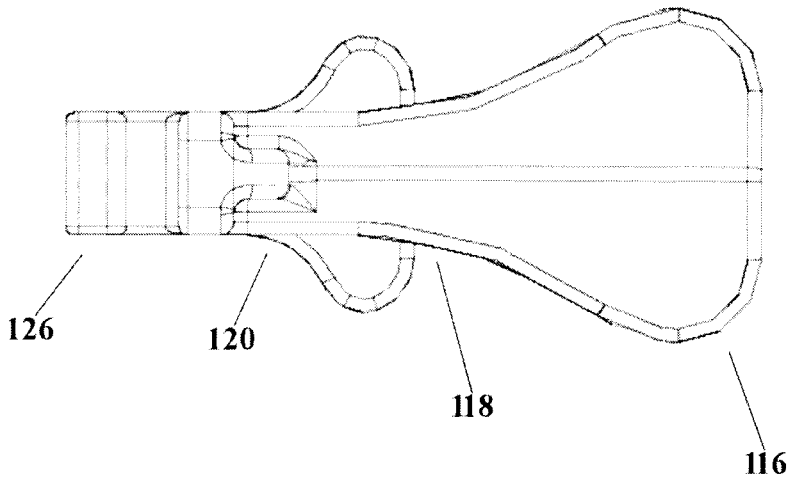
FIG. 15 is a handle-end view of the finger portion of FIG. 13.
Figure 16:
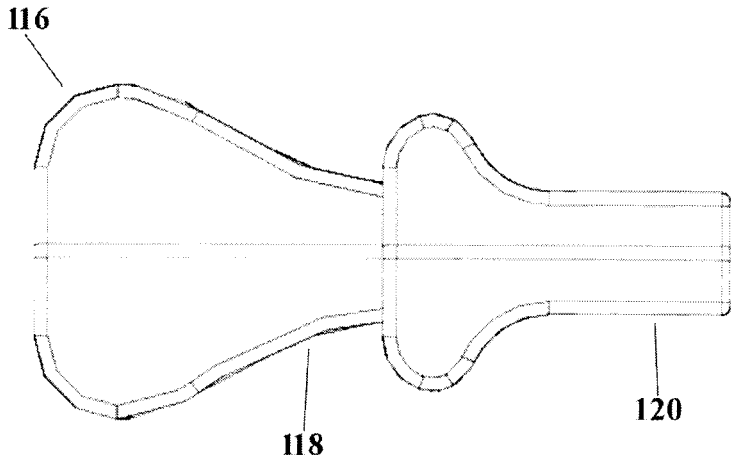
FIG. 16 is a tooth-end view of the finger portion of FIG. 13.
Figure 17:
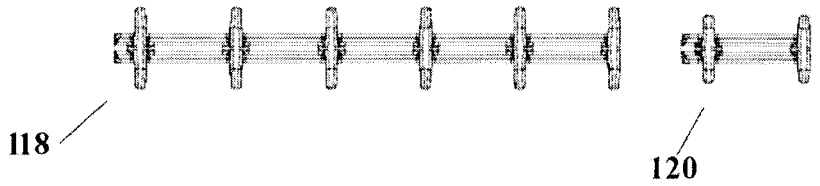
FIG. 17 is a front view of the finger portion of FIG. 13.
Figure 18:
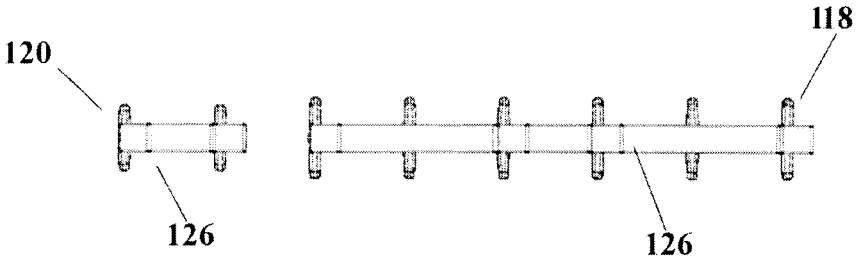
FIG. 18 is a back view of the finger portion of FIG. 13.

Referring to the Figures, wherein like numerals indicate corresponding parts throughout the several views, there is generally illustrated an apparatus for cutting hair 100. The hair cutting apparatus 100 includes a comb 102, in this embodiment having a spine 104 from which a handle 106 extends axially and a plurality of teeth 108 extends transversely, and more particularly as illustrated a first plurality of teeth 110 and a second plurality of teeth 112 extend oppositely. Oppositely extending teeth accommodate right-handed and left-handed stylists and people who cut their own hair; however, they are not necessary to obtain the benefits taught herein, which can be obtained from embodiments having only a first plurality of teeth 110.

The comb 102 also supports at least one finger 114 that extends transversely from the spine 104 substantially perpendicularly to the plurality of teeth 108. As illustrated, the at least one finger 114 terminates in a lobe 116 that is shaped to comfortably follow a surface of the head of a person whose hair is being cut using the apparatus for cutting hair 100 and shaped to gently scoop and lift hair away from the person's head as needed.

In this embodiment the at least one finger 114 comprises a first plurality of fingers 118 connected together and a second plurality of fingers 120 connected together. It will be seen that the first plurality of fingers 118 and the second plurality of fingers 120 differ in at least one of the number of fingers 114 and the length of fingers 114. Such differences provide adjustability for both length and angle of cut. The first plurality of fingers 118 and the second plurality of fingers 120 might also differ in the spacing between fingers 114.

The relative spacing between the teeth 108, between the fingers 114, and/or between the teeth 108 and the fingers 114 is selected so that the comb 102 passes comfortably through the person's hair, so that the hair can be lifted, measured, cut and more generally styled. For example, it has been found that one suitable amount of spacing is 2 mm between the teeth 108 and 12 mm between the fingers 114.

In greater detail, the spine 104 includes a channel 122 for releasably retaining the at least one finger 114. The channel 122 has at least one eye 124 and the at least one finger 114 has at least one hook 126 that is complementary with the at least one eye 124 for releasable retainment.

As illustrated, the spine 104 includes a plurality of eyes 124 that are complementary with the at least one hook 126 for releasably retaining the at least one finger 114 in a plurality of positions along the spine 104.

The comb 102 may even include one or more eyes 124 in the handle 106 to provide temporary storage for one or more fingers 114 not currently being used.

Operation

In general terms, a stylist uses the apparatus for cutting hair 100 as a convenient measurement aid to cut hair to a predetermined length. More specifically, the stylist combs a client's hair through the teeth 108 of the comb 102, until the lobe 116 of the at least one finger 114 rests against a surface of the client's head and the hair hangs over the spine 104 of the comb 102. The stylist then cuts along the spine 104 to remove all but a predetermined length of hair. Although having wide application, some of the teachings herein have particularly application to cutting hair to a short length, for example three inches or less.

The curved shape of the lobes helps the stylist to slide the comb 102 comfortably over the surface of the client's head and to adjust the angle of the comb 102 with respect to the head.

To cut various lengths and various styles, the stylist can select various pluralities and combinations of pluralities of fingers 114. For example, to make a tapered cut, the stylist would select fingers 114 of different length, as illustrated. With combinations of pluralities of fingers 114 attached, the stylist can quickly and easily switch between placing the lobes 116 of only the longest fingers 114 against the client's head to achieve a straight cut or placing the lobes 116 of a combination of fingers 114 of different length against the client's head to achieve a tapered cut.

For further adjustability, the stylist can attach fingers 114 to the comb 102 at various positions along the spine 104 if, as illustrated, the spine 104 has more eyes 124 than there are corresponding hooks 126. In this way, the stylist can adjust taper angle not only by selecting pluralities of fingers 114 having a predetermined relative length, but also be installing the pluralities of fingers 114 at predetermined positions along the length of the spine 104. Still further, the stylist can tilt the comb 102 to achieve a tapered cut, placing the end of the comb 102 and adjacent lobes 116 against the client's head for reference.

This arrangement provides not only adjustability, but also repeatability and communicability. A particular stylist can subsequently repeat a previous cut by simply reattaching the same fingers 114 to the comb 102 at the same locations along the spine 104. The stylist can also communicate this arrangement to another stylist by specifying the particular fingers 114 and the particular attachment points along the spine 104. This communicability is useful for example for salon chains, where clients may have an ongoing relationship with the chain but not a specific stylist.

Those skilled in the art will recognize that, although the apparatus for cutting hair 100 has been described for use by stylists and their clients, home users would also benefit from its advantages, either for cutting hair for family and friends or cutting their own hair.

Obviously, many modifications and variations of the present invention are possible in light of the above teachings, which may be practiced otherwise than as specifically described.

The invention claimed is:

1. An apparatus for cutting a person's hair, comprising:

a) a comb having i) a spine that includes a channel having at least one eye;

ii) a handle that extends axially from the spine, and iii) a plurality of teeth that extends transversely from the spine;

b) a first plurality of fingers that are connected together, the first plurality of fingers having at least one hook that is complementary with the at least one eye for releasable retainment therewith, the first plurality of fingers being releasably retained by the channel of the spine to extend transversely from the spine substantially perpendicularly to the plurality of teeth; and c) a second plurality of fingers that are connected together and that are releasably retained by the spine to extend transversely from the spine substantially perpendicularly to the plurality of teeth, wherein the first plurality of fingers and the second plurality of fingers are independently releasably retainable by the spine in a plurality of positions along the spine.

2. An apparatus as claimed in claim 1, wherein the spine has a plurality of eyes that are complementary with the at least one hook for releasably retaining the first plurality of fingers in the plurality of positions along the spine.

3. An apparatus as claimed in claim 2, wherein the comb has one or more eyes in the handle to provide temporary storage for the second plurality of fingers not currently being used.

4. An apparatus as claimed in claim 1, wherein the first plurality of fingers and the second plurality of fingers differ in at least one of:

number of fingers, length of fingers, and spacing between fingers.

5. An apparatus as claimed in claim 4, wherein the spacing between at least one of:

a) the teeth, b) the fingers, and c) the teeth and the fingers is selected so that the comb passes comfortably through the person's hair, so that the hair can be lifted, measured, cut and more generally styled.

6. An apparatus as claimed in claim 5, wherein the spacing between adjacent teeth is substantially 2 mm and the spacing between adjacent fingers is 12 mm.

7. The apparatus as claimed in claim 1 wherein at least one finger in the first plurality of fingers terminates in a lobe that is shaped to comfortably follow a surface of the person's head and shaped to gently scoop and lift hair away from the person's head.

* * * * *